United States Patent [19]

Lentjes

BEST AVAILABLE COPY

[11] Patent Number: 4,473,165

[45] Date of Patent: Sep. 25, 1984

[54] VACUUM-MOULDED CONTAINER FOR STACKING

[76] Inventor: Theodor Lentjes, Vinklother Mark 16, 4600 Dortmund-Wichlinghofen, Fed. Rep. of Germany

[21] Appl. No.: 307,553

[22] Filed: Oct. 1, 1981

[30] Foreign Application Priority Data

Oct. 1, 1980 [DE] Fed. Rep. of Germany ..... 3037038

[51] Int. Cl.[3] ..... B65D 6/38

[52] U.S. Cl. ..... 220/74; 206/508; 206/519; 220/72; 220/276; 220/306; 220/359; 220/DIG. 12; 229/43

[58] Field of Search ..... 220/74, 72, 306, 307, 220/276, 359, DIG. 12, DIG. 14; 206/507, 519, 508, 447, 460, 813; 229/43, 485 B; 264/553; 215/1 C

[56] References Cited

U.S. PATENT DOCUMENTS

| | | | |
|---|---|---|---|
| 1,098,444 | 6/1914 | Ingalls | 220/74 X |
| 2,063,999 | 12/1936 | Harrison | 229/485 B |
| 2,263,185 | 11/1941 | Ottesen | 220/226 |
| 2,687,157 | 8/1954 | Cowan | 220/DIG. 12 |
| 3,023,926 | 3/1962 | Wilke | 220/306 |
| 3,101,864 | 8/1963 | Glickman | 220/72 X |
| 3,232,512 | 2/1966 | Wanderer | 206/519 X |
| 3,303,964 | 2/1967 | Luker | 206/519 |
| 3,350,045 | 10/1967 | Mayers | 24/DIG. 11 |
| 3,505,441 | 4/1970 | Goetgheluck | 264/553 X |
| 3,743,131 | 7/1973 | Croyle et al. | 220/307 X |
| 3,987,829 | 10/1976 | Leone | 220/72 X |
| 4,006,839 | 2/1977 | Thiel et al. | 229/43 X |
| 4,091,930 | 5/1978 | Buchner et al. | 220/276 X |
| 4,125,665 | 11/1978 | Bemmets et al. | 220/359 X |
| 4,286,713 | 9/1981 | Marchais | 206/508 |
| 4,303,176 | 12/1981 | Swartzbaugh | 220/306 |

FOREIGN PATENT DOCUMENTS

| | | | |
|---|---|---|---|
| 869361 | 4/1971 | Canada | 215/1 C |

*Primary Examiner*—William Price
*Assistant Examiner*—Gary E. Elkins
*Attorney, Agent, or Firm*—Sughrue, Mion, Zinn, Macpeak and Seas

[57] ABSTRACT

A container comprises an open-mouthed receptacle and a lid. The receptacle has side walls and a base, and is formed with an outwardling-extending rim which surrounds the open mouth of the receptacle. The receptacle is formed by vacuum moulding a sheet of plastics material whose external dimensions correspond to the external dimensions of the rim. The ratio of the thickness of the rim to that of the rest of the receptacle is at least 4.5:1.

9 Claims, 5 Drawing Figures

VACUUM-MOULDED CONTAINER FOR STACKING

BACKGROUND TO THE INVENTION

This invention relates to a container comprising a receptacle and a lid, preferably for use as a one-way transport container for disposable matter such as poisonous substances and/or hospital waste.

One-way transportion containers are known of greatly varying design, and which are made from very greatly differing materials. It is known, for example, to store washing powder or the like in cardboard cylinders. Such cardboard cylinders are environmentally acceptable, but expensive to produce. Moreover, they are extremely sensitive to moisture, so that they are unsuitable for containing liquids, or for storage in spaces that are not completely dry.

For the purpose of receiving fluids it is, therefore, usual to use injection-moulded plastics buckets. These are, however, relatively expensive to produce.

It is also known to use refuse bags made of paper or plastics material. Such refuse bags can be stored in a space-saving manner when not in use, and they are economical to produce. However, they are extremely sensitive to sharp-edged refuse.

In the case of special types of refuse, for example medical refuse from hospitals, doctors' surgeries or laboratories, it is known (see DE-PS No. 22 33 435) to collect such refuse in, for example, refuse bags or in cardboard cylinders lined with water-tight material. These bags or cylinders are then sealed, and taken to a place where the refuse is burnt. These known containers suffer from the disadvantage that they cannot, with certainty, prevent the escape of liquid such as blood. Moreover, there is the risk that pointed or sharp articles (such as throw-away syringes) in the refuse will pierce the walls, so that there is danger of injury to persons handling the containers.

For this reason, hospitals often make use of large-capacity domestic plastics buckets produced by injection moulding. As previously mentioned, such containers are comparatively expensive. Moreover, still greater expense is entailed in emptying such buckets for further use, and in then cleaning and disinfecting them.

The aim of the invention is, therefore, to provide a reliable transportable container, which can be stored in a space-saving manner, which can be sealed in an airtight manner and which offers protection as regards the escape of liquids and against sharp-edged refuse.

SUMMARY OF THE INVENTION

The present invention provides a container comprising an open-mouthed receptacle and a lid, the receptacle having side walls and a base and being formed with an outwardly-extending rim which surrounds the open mouth of the receptacle, wherein the receptacle is formed by vacuum moulding, and wherein the ratio of the thickness of the rim to that of the rest of the receptacle is at least 4.5:1.

A receptacle made by vacuum moulding plastics sheet material results in the container being relatively economical to produce, and hence in it being usable as a throw-away article. Moreover, the use of such material ensures liquid-tightness and sufficient rigidity, when shaped by a suitable method, so that the containers can be stacked both when empty and when filled.

It is known to use vacuum-moulded containers, for example for accommodating foods such as curds or yoghurt intended for immediate consumption. However, because of their structure, the known containers are not suitable for safely transporting fairly large quantities of refuse sealed up in an airtight manner. The container of the invention is designed for capacities in excess of 25 liters.

Advantageously, the external dimensions of the rim correspond to the external dimensions of the sheet from which the receptacle is formed by vacuum moulding. This ensures that there is no wastage of material when making the receptacle, as there is no need to cut the rim down to the required size.

The side walls of the receptacle may be formed with reinforcing corrugations. Preferably, the receptacle has a generally square cross-section, and the reinforcing corrugations are distributed symmetrically along each of the four side walls thereof. Advantageously, spacer corrugations are formed in the side walls immediately below the rim.

Advantageously, the side walls of the receptacle taper from the rim to the base. Where the receptacle is square and has walls which taper from the rim to the base, the container is such that stacking can be carried out very easily when the containers are empty, so that very little space is required for storing them. Moreover, the filled containers can be advantageously disposed more closely together in a rectangular arrangement on the loading surface of a transport vehicle. The good stackability of the empty containers is further increased by the corrugations formed in their walls, which corrugations prevent the empty containers, stacked one within the other, from locking together.

Advantageously, the upper surface of the rim is provided with an adhesive foil, and the adhesive foil is covered by a protective strip. Preferably, the adhesive foil and the protective strip are formed with notches which extend from the exterior over parts of their width.

Preferably, the base of the receptacle is formed with an inwardly-directed reinforcing and stacking curvature, and the lid is formed with an outwardly-directed reinforcing and stacking curvature shaped to correspond with said inwardly-directed reinforcing and stacking curvature. This helps to ensure good stacking properties.

Advantageously, the side walls of the receptacle have, in the zone below the rim, inwardly-directed inclined surfaces which act as centering and bearing surfaces for the lid, and the lid is formed with an outwardly-extending rim which has inwardly-directed inclined surfaces, which co-operate with the inclined surfaces of the rim of the receptacle. The inwardly-directed inclined surfaces of the rim of the lid co-operate in a shape-locking manner with the inclined surfaces of the rim of the receptacle, and thus prevent transverse forces from acting on the adhesive foil arranged between the container and the lid. The fitted lid thus provides a safe surface on which the next container can be stacked.

Conveniently, the lid has an upwardly-directed stacking bead. The stacking beads fix the containers, stacked one upon the other, in position. This fixing effect is reinforced by co-operation between the curvatures of the lids and the receptacles.

Preferably, the lid is formed by vacuum moulding a substantially thinner sheet of material than that from which the receptacle is formed.

In a preferred embodiment, the stacking bead is provided with a tear-off strip. This arrangement is particularly advantageous when the lid is unreleasably secured on the receptacle with the aid of a foil-welding machine. The arrangement is also particularly advantageous in the case of pulverulent substances such as washing powder and the like. Conveniently, the stacking bead is a double bead and the tear-off strip is formed between the two beads and is made of thicker material.

Alternatively, the lid may be provided with a snap-action seal. In this case, the rim of the lid is connected to the rim of the receptacle by means of lugs, the lugs being formed integrally with the rim of the lid. The lugs resiliently engage over the rim of the receptacle.

In a special arrangement, the receptacle and the lid are made in one piece by a vacuum moulding process. In this case, the lid is attached to the receptacle along a portion of the rim of the receptacle, said portion being of reduced thickness. The price of such containers is a decisive selling factor. The total savings due to reduced handling and machine times, as well as the saving in material and avoidance of scrap, reaches a very high level as a result of using the invention.

The invention also provides a method of making a receptacle having a base, side walls and an open mouth surrounded by an outwardly-extending rim, the method comprising the steps of taking a sheet of plastics material whose external dimensions correspond to those of the rim of the finished receptacle, and vacuum moulding the base and side walls in such a manner that the thickness of the rim is at least 4.5 times the thickness of the base and the side walls.

BRIEF DESCRIPTION OF THE DRAWINGS

Two forms of container constructed in accordance with the invention will now be described, by way of example, with reference to the accompanying drawings, in which.

DESCRIPTION OF PREFERRED EMBODIMENTS

Figure 1:
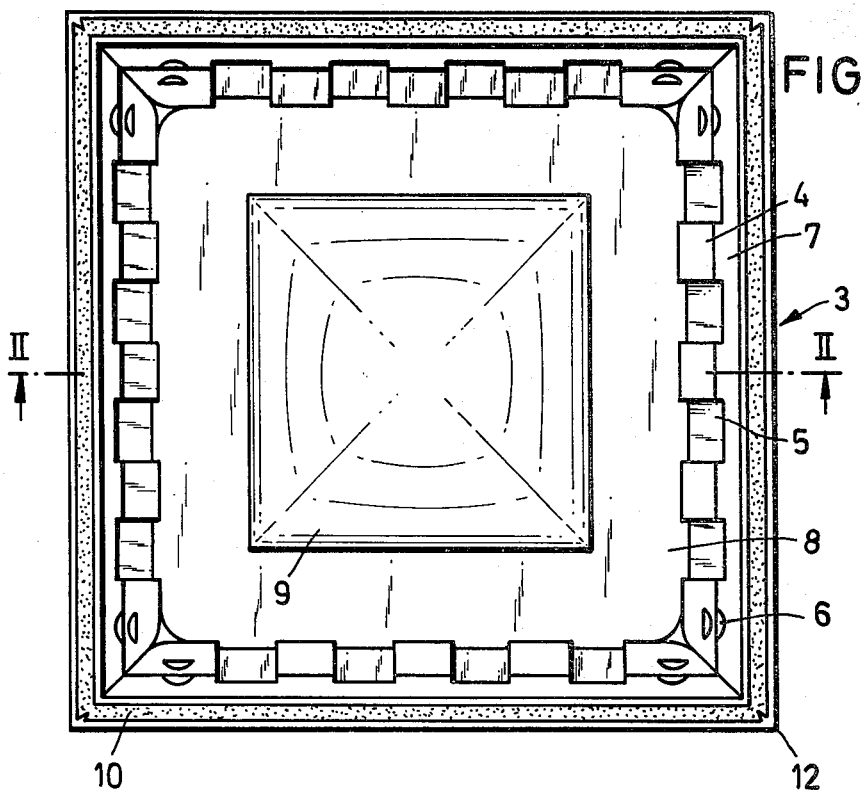
FIG. 1 is a plan view of the first form of container.
Figure 2:
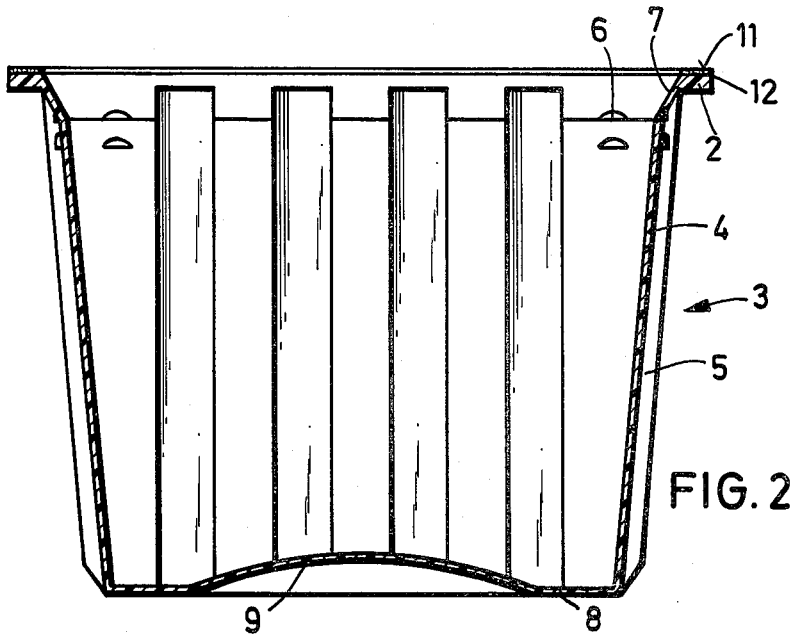
FIG. 2 is a cross-section taken on the line II—II of FIG. 1.
Figure 3:
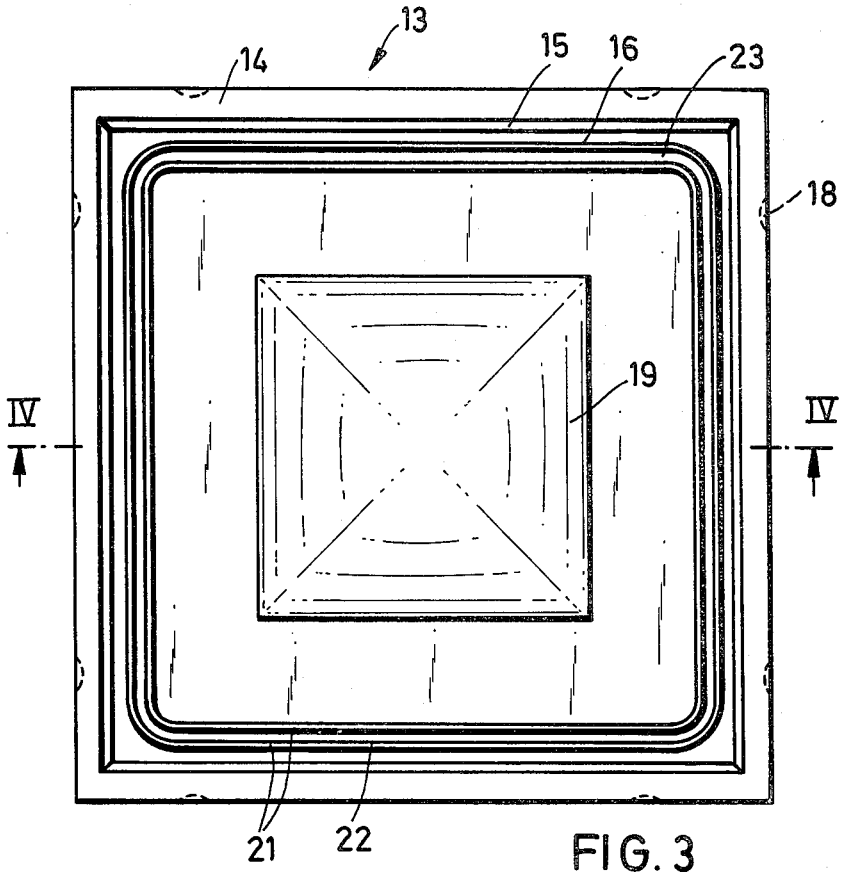
FIG. 3 is a plan view of the lid of the container of FIGS. 1 and 2.
Figure 4:
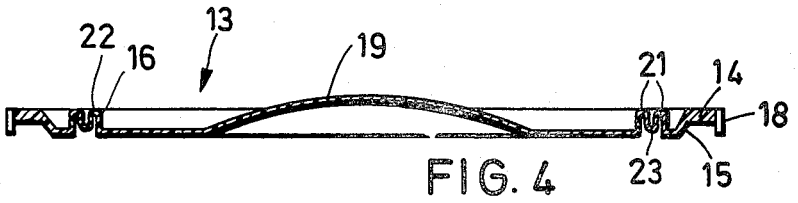
FIG. 4 is a cross-section taken on the line IV—IV of FIG. 3.

Referring to the drawings, FIGS. 1 to 4 show a container designated generally by the reference numeral 1. The container 1 consists of a receptacle 3 and a lid 13. The receptacle 3 has a handling and reinforcing rim 2, the thickness of which is at least 4.5 times as great as the thickness of the walls 4 of the receptacle. An adhesive foil 10 is provided on the upper surface of the reinforcing rim 2, the adhesive foil being covered by a protective film 11. Preferably, the adhesive foil 10 and the protective film 11 are each made in one piece; and, at the corners 12 of the receptacle 2, they have incisions (notches) which extend at least over portions of their width. The upper parts of the downwardly-tapering walls 4 of the receptacle 3 are formed by inclined surfaces 7. The inclined surfaces 7 act as centering and supporting surfaces for corresponding inclined surfaces 15 of the lid 13 (as is described below). Since the walls 4 of the receptacle 3 are relatively thin, reinforcing corrugations 5 are provided for increasing their strength. Furthermore, corrugations 6 are formed in the walls of the receptacle 3, the corrugations 6 preventing locking of the empty receptacles when they are stacked one within another. The base 8 of the receptacle 3 is additionally rigidised by an inwardly-directed reinforcing and stacking curvature 9.

The receptacle 3 can be closed in an air-tight manner by means of the lid 13. The lid 13, therefore, likewise has a rim 14, the dimensions of which correspond to those of the reinforcing rim 2 of the receptacle 3. After removal of the protective film 11, the stable rim 14 of the lid 13 is pressed on to the adhesive foil 10, and seals off the receptacle 3 in an air-tight manner. To prevent this adhesive seal from being affected by transverse loads, inclined surfaces 15 are incorporated in the lid 13. These inclined surfaces 15 co-operate with the inclined surfaces 7 of the receptacle 3. The lid 13 also has a stacking bead 16, the dimensions of which are selected to suit the outer contour of the base 8 of the receptacle 3. This stacking bead 16 thus prevents slipping of the filled containers, stacked one upon another. The lid 13 is formed with an upwardly-directed reinforcing and stacking curvature 19, which, when stacking is carried out, engages in the reinforcing and stacking curvature 9 of the vessel arranged above it. This results in additional stability.

Although the above-described inherently rigid container is designed preferably for special refuse, such as occurs, for example, in hospitals or the like, it is also eminently suitable as a one-way transport receptacle. Thus, for example, after the receptacle 3 has been filled with the material that is to be carried away, the lid 13 is unreleasably sealed by means of a foil-welding machine or the like. In order to open the container, a tear-off strip 23 is provided, this being formed integrally with the stacking bead 16. For this purpose, the stacking bead 16 is designed as a double bead 21, the tear-off strip 23 being provided between the two projecting parts 22. The tear-off strip 23 is made of thicker material, and extends over a short distance. The strip 23 can be easily torn from the lid 13, so that the receptacle 3 becomes accessible.

The receptacle 3 is made by vacuum moulding a sheet of plastics material. The sheet of plastics material is chosen to have the same external dimensions as those of the rim 2 of the finished receptacle. By making the receptacle 3 from a sheet of material of these dimensions, the amount of material wasted is negligible. Thus, there is no need to cut the rim 2 of the receptacle 3 down to the required size. Moreover, thicker sheets can be used in the moulding process, so that it is possible to draw the material which flows during the vacuum moulding operation completely from the material positioned within the edge portion of the sheet that is to form the rim. Consequently, the edge portion is largely unaffected by the vacuum moulding operation, so that the thickness of the rim 2 is substantially the same as that of the sheet.

By vacuum moulding using the negative-mould method, no core mould is required, so that the material thickness can be adjusted as desired. The relatively rigid rim 2 of the receptacle 3 permits handling of the container 1 without damaging the thin walls or base of the receptacle. Moreover, the rim 2 forms an ideal connection surface for the lid 13 which must be attached thereto in an air-tight manner. The lid 13 may be stuck to the rim 2 by means of a double-sided adhesive tape. Alternatively, it can be welded to the receptacle rim 2 by means of a heat-welding machine. The lid 13 is also made by vacuum moulding.

In place of an adhesive foil or a tear-off strip, other types of seal are possible. Thus, the rim 14 of the lid can be provided with lugs or recesses 18, which engage over the reinforcing rim 2 of the receptacle 3, and provide a snap-action seal which can be opened when necessary.

Figure 5:
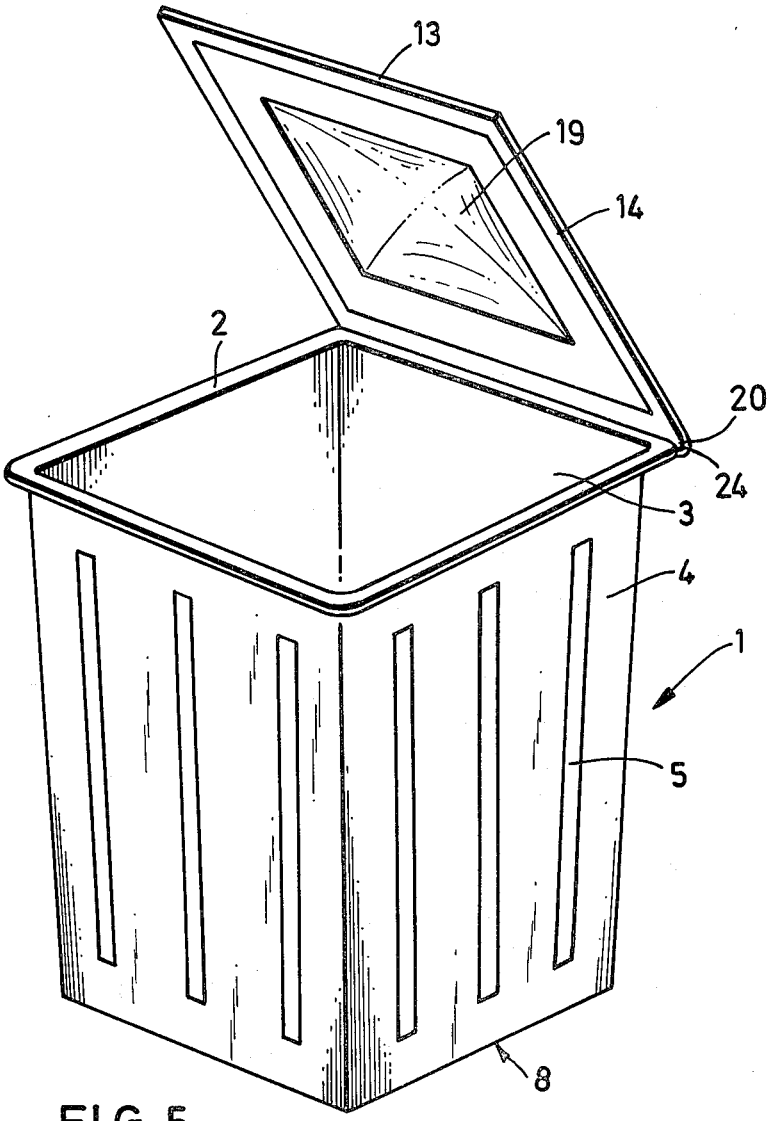
FIG. 5 is a perspective view of the second form of container.

Although the inherently rigid container of the invention is preferably of two-part construction, that is to say it consists of a receptacle 3 and a separate lid 13, it is possible to produce a container as a one-piece article. In this form of construction, (see FIG. 5), a break-away edge 20, which preferably takes the form of an extended channel 24 is provided between the rim 2 of the receptacle 3 and the rim 14 of the lid 13. In this case, the edge 20 may be provided with a row of perforations. The perforations facilitate bending of the lid 13 relative to the receptacle 3, and the remaining thicker portions of the edge 20 stiffen the connection and so increase security during transport.

Obviously, the containers described above could be modified in a number of ways. For example, the receptacle 3 could be of double-walled formation. In other words, two receptacles could be pushed one into the other so that a sufficiently large gap is left between their respective side walls that hypodermic syringes or other pointed objects which may be in the refuse cannot penetrate to the exterior and cause injuries to personnel. Where the receptacle is of double-walled formation, the interspace between the walls can be filled with an inert gas. This is particularly useful where the container is used to transport strongly oxidising materials. Alternatively, the interspace could be foam-filled.

Moreover, the lid could be modified by providing inwardly-extending indentations which enable the lid to be snapped shut.

Where the lid is provided with a tear-off strip, the container can also be used for the bulk storage of large packages of chemicals, powder, foodstuffs etc.

The container described above could be used as a cold or "thermos" container.

I claim:

1. A container, comprising: an open-mouthed receptacle and a lid, the receptacle having side walls and a base and being formed with an outwardly-extending rim which surrounds the open mouth of the receptacle, wherein:

(a) the receptacle is formed by vacuum moulding,
(b) the ratio of the thickness of the rim to that of the rest of the receptacle is at least 4.5:1,
(c) the lid has an upwardly-directed stacking bead,
(d) the stacking bead is provided with a tear-off strip, and
(e) the stacking bead is a double bead and the tear-off strip is formed between the two beads and is made of thicker material.

2. A container according to claim 1, wherein the external dimensions of the rim correspond to the external dimensions of the sheet from which the receptacle is formed by vacuum moulding.

3. A container according to claim 1, wherein the side walls of the receptacle are formed with reinforcing corrugations.

4. A container according to claim 3, wherein the receptacle has a generally square cross-section, and the reinforcing corrugations are distributed symmetrically along each of the four side walls thereof.

5. A container according to claim 1, wherein spacer corrugations are formed in the side walls immediately below the rim.

6. A container according to claim 1, wherein the side walls of the receptacle taper from the rim to the base.

7. A container according to claim 1, wherein the upper surface of the rim is provided with an adhesive foil.

8. A container according to claim 1, wherein the lid is provided with an outwardly-extending rim whose dimensions correspond to those of the rim of the receptacle.

9. A container according to claim 8, wherein the rim of the lid is connected to the rim of the receptacle by means of lugs, the lugs being formed integrally with the rim of the lid.

* * * * *